US005146970A

United States Patent [19]

Danieli

[11] Patent Number: 5,146,970

[45] Date of Patent: Sep. 15, 1992

[54] SUPPORT FOR CURTAINS, PARTICULARLY CURTAINS OF THE ADJUSTABLE SUN-LOUVER TYPE

[75] Inventor: Remo Danieli, Padua, Italy

[73] Assignee: Solar Systems SpA, Italy

[21] Appl. No.: 669,692

[22] Filed: Mar. 14, 1991

[30] Foreign Application Priority Data

Mar. 14, 1990 [IT] Italy ..... 41550 A/90

[51] Int. Cl.[5] ..... E06B 9/30

[52] U.S. Cl. ..... 160/173; 160/168.1; 160/900

[58] Field of Search ..... 160/173, 900, 178.1, 160/168.1

[56] References Cited

U.S. PATENT DOCUMENTS 4,706,433 11/1987 Rijnders ..... 160/900 X

FOREIGN PATENT DOCUMENTS 3525590 1/1987 Fed. Rep. of Germany ... 160/168.1

*Primary Examiner*—Blair M. Johnson

*Attorney, Agent, or Firm*—Sughrue, Mion, Zinn, Macpeak & Seas

[57] ABSTRACT

A support for curtains, particularly curtains of the adjustable sun-louver type, comprises a plurality of carts fitting slidably in a slideway and being interconnected serially to one another by a string attached to each cart by means of a corresponding anchor member effective to bias the same to huddle into side-by-side bights above the carts, with the latter packed together in a gathered position. Each anchor member comprises at least one support arm jutting out from the corresponding cart and adapted to hold the string some distance above the corresponding cart.

11 Claims, 3 Drawing Sheets

SUPPORT FOR CURTAINS, PARTICULARLY CURTAINS OF THE ADJUSTABLE SUN-LOUVER TYPE

BACKGROUND OF THE INVENTION

This invention relates to a support for curtains, particularly curtains of the adjustable sun-louver type, comprising a plurality of carts fitting slidably in a slideway and being interconnected, serially to one another or in clusters, by a string for sequentially towing them along said slideway from a gathered position, where said carts are packed together, to a spread position where said carts are set at pitch distances from one another along said slideway, said string being attached to each cart by a corresponding anchor member effective to bias said string to huddle into side-by-side bights above said carts when the latter are packed together in said gathered position.

A support having the above-noted features is known from articles currently available on the market.

This prior support design has, over more traditional supports with carts interconnected by sequential towing arrangements which comprise metal or plastics reeds connecting each cart to an adjacent one, the advantage of a smoother and quieter run of the carts as these are towed along the slideway.

They are provided with anchor members for attaching the towing string to each cart, which include in one embodiment a reed made fast with the cart at an upper portion of the latter (between the cart and the back of the tubular slideway wherealong the cart is to run) and so bent over as to define a socket wherein the towing string can be clamped to make it fast with its corresponding cart.

The string socket is curvilinear and bent over such that the entry and exit sections of the string form a smaller angle than 180° therebetween, and are therefore convergent toward the socket on the cart. This arrangement encourges the towing string to set into side-by-side bights, in a substantially sinusoidal pattern, as the carts are towed toward the gathered position.

It has been common practice to use a relatively strong and stiff string flattened in cross-section and laid on edge (with the major axis vertical) so as to be stiffer in the vertical direction. The string is subjected to a heat-setting treatment to further enhance its stiffness. This is done in order to prevent string bights from sagging down between adjacent carts to block them by nesting in between the carts and the slideway.

A first drawback of supports of that type is that the longest pitch distance between carts is restricted to the maximum string length that can be huddled in the manner just described within the slideway (which length is approximately twice the cross dimension of the slideway). This maximum pitch distance is to be obtained, where the anchor member for the string locates at one transverse end of the cart, i.e. close against one longitudinal wall of the slideway, such that the string bights can reach as far as the opposite slideway wall. In fact, the string tends to arrange itself into orthogonal bights with the longitudinal walls of the slideway, and if they are to be crowded together and stretched smoothly, it is necessary that they be not squeezed against the opposite wall of the slideway. This arrangement, however, brings about a further problem inasmuch as, with the point of attachment of the string to the cart offset from the vertical axis of the latter, the pull applied to the string in order to displace the carts will generate a moment tending to cock the carts in the slideway. To resist this natural tendency to a cocked position during operation, the carts have to be designed with a suitably longer dimension along a parallel direction to the slideway axis, which results in increased space requirements for the carts when in the gathered position.

An added problem is then brought about by the relative stiffness of the towing string, made necessary as noted above to prevent the latter from festooning or sagging down in between adjacent carts. This stiffness implies some springback in said string, with the carts in the gathered position, tending to push the carts apart. In addition, this same stiffness, when compounded with the bend imparted to the string by the anchor members, will set up an elastic reaction tending to resist full spreading of the carts along the slideway and to produce a springback pull therebetween.

SUMMARY OF THE INVENTION

The technical problem that underlies this invention is to provide a support for curtains which is so structured as to afford optimum gathering of the towing string into side-by-side bights, with the carts in their packed-together position, and to overcome all of the drawbacks with which the prior art is beset.

This problem is solved according to the invention by a support for curtains as indicated being characterized in that said anchor member comprises at least one support arm for said string jutting out from a corresponding cart and being adapted to hold said string some distance above the corresponding cart.

BRIEF DESCRIPTION OF THE DRAWINGS

The features and advantages of this invention will be more clearly appreciated from the following detailed description of a preferred embodiment thereof, given by way of illustration and not of limitation with reference to the accompanying drawings, where.

DETAILED DESCRIPTION OF THE INVENTION

Figure 1:
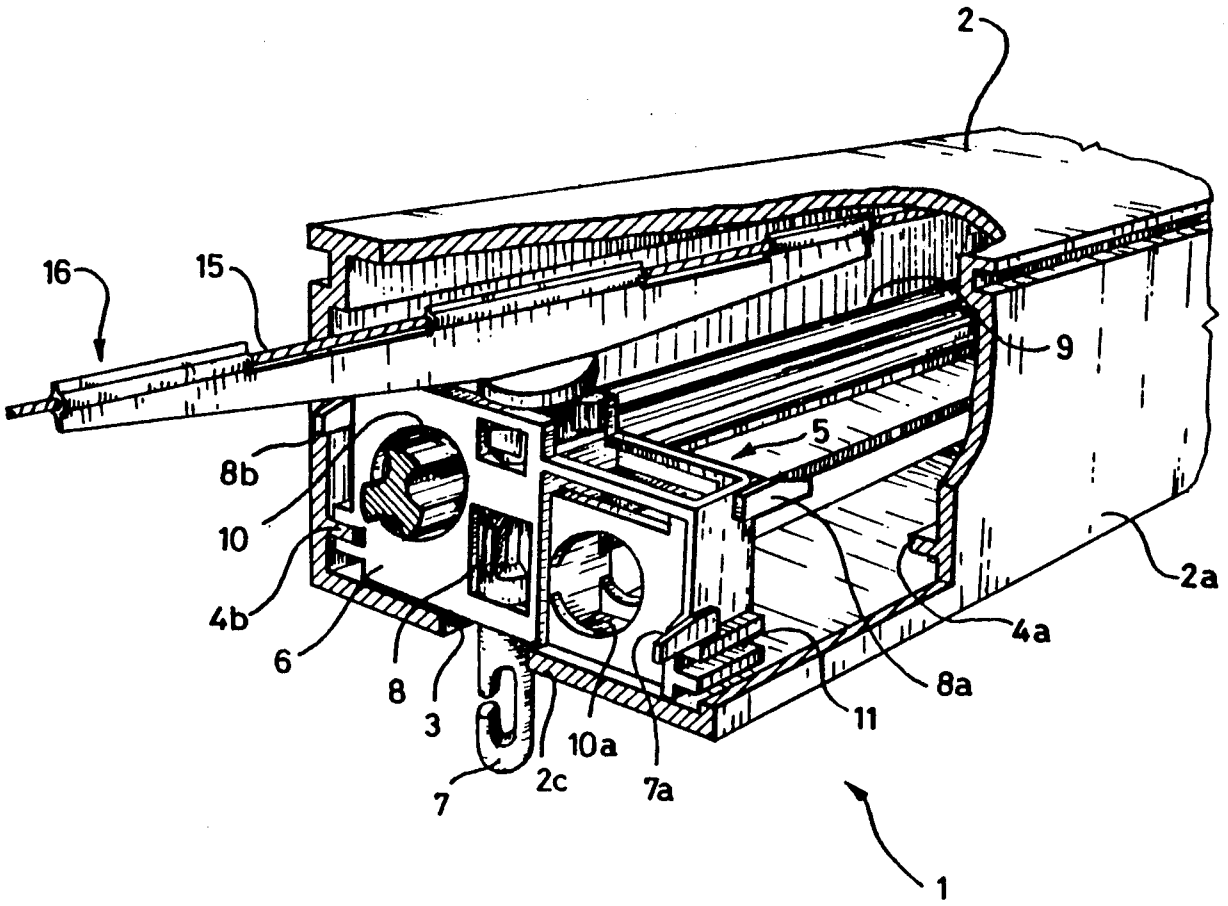
FIG. 1 is a part-sectional perspective view of a curtain support embodying this invention.

In the drawings, generally shown at 1 is a support for curtains embodying this invention.

The support 1 comprises a tubular slideway 2 having a substantially rectangular cross-sectional shape with side walls 2*a*, 2*b* and a bottom wall 2*c* which defines a longitudinal aperture 3 spanning the full length of the slideway.

Each wall 2*a*, 2*b* is formed, on the slideway 2 interior, with a respective rib 4*a*, 4*b* lying parallel to the bottom wall 2*c*.

A plurality of carts, all alike and shown at 5, fit slidably inside the slideway 2. Each cart 5 comprises an essentially flattened parallelepipedic body 6 having a hook 7 mounted centrally to its lower portion which is intended to suspend a curtain panel or louver and extends through the aperture 3, said hook being rotatable to a limited extent about its vertical axis by means of a conventional worm mechanism 8.

Said mechanism 8 is driven through a splined bar 9 running inside the slideway 2 and fitting slidably in a friction clutch to drive the mechanism 8 worm, which is in turn received in a hole 10 in the body 6.

Each cart 5 also has, on its opposed minor side walls, respectively shown at 6*a* and 6*b*, two parallel projections defining a groove 11 therebetween for receiving a corresponding rib 4*a,b* whereby the cart 5 is held guided in the slideway 2.

From each side wall 6*a*, 6*b*, there extend two opposed shoes respectively indicated at 7*a*, 8*a* and 7*b*, 8*b*, of which the shoes denoted by 7*a,b* and those denoted by 8*a,b* project in turn from opposed portions of the body 6 in order for the carts 5 to be huddled together into a pack without corresponding shoes 7*a,b* and 8*a,b* interfering with the shoes of the adjacent carts. These shoes, which effectively increase the cart dimension along the cart running direction without enlarging the cart space requirement, are effective to prevent the carts from cocking inside the slideway 2 and jam the support.

To move the carts 5 along the slideway 2, a towing string 15 is provided along which as many anchor members 16 are attached as are the carts to be towed, a return string (not shown) being passed through a further hole 10*a* in the body 6. The anchor members 16 are distributed along the towing string at pitch distances which will depend on the pitch distance selected for the curtain louvers to be carried on the support, and snap fitted to their corresponding carts, at the cart upper portion, in a manner to be explained.

Figure 2:
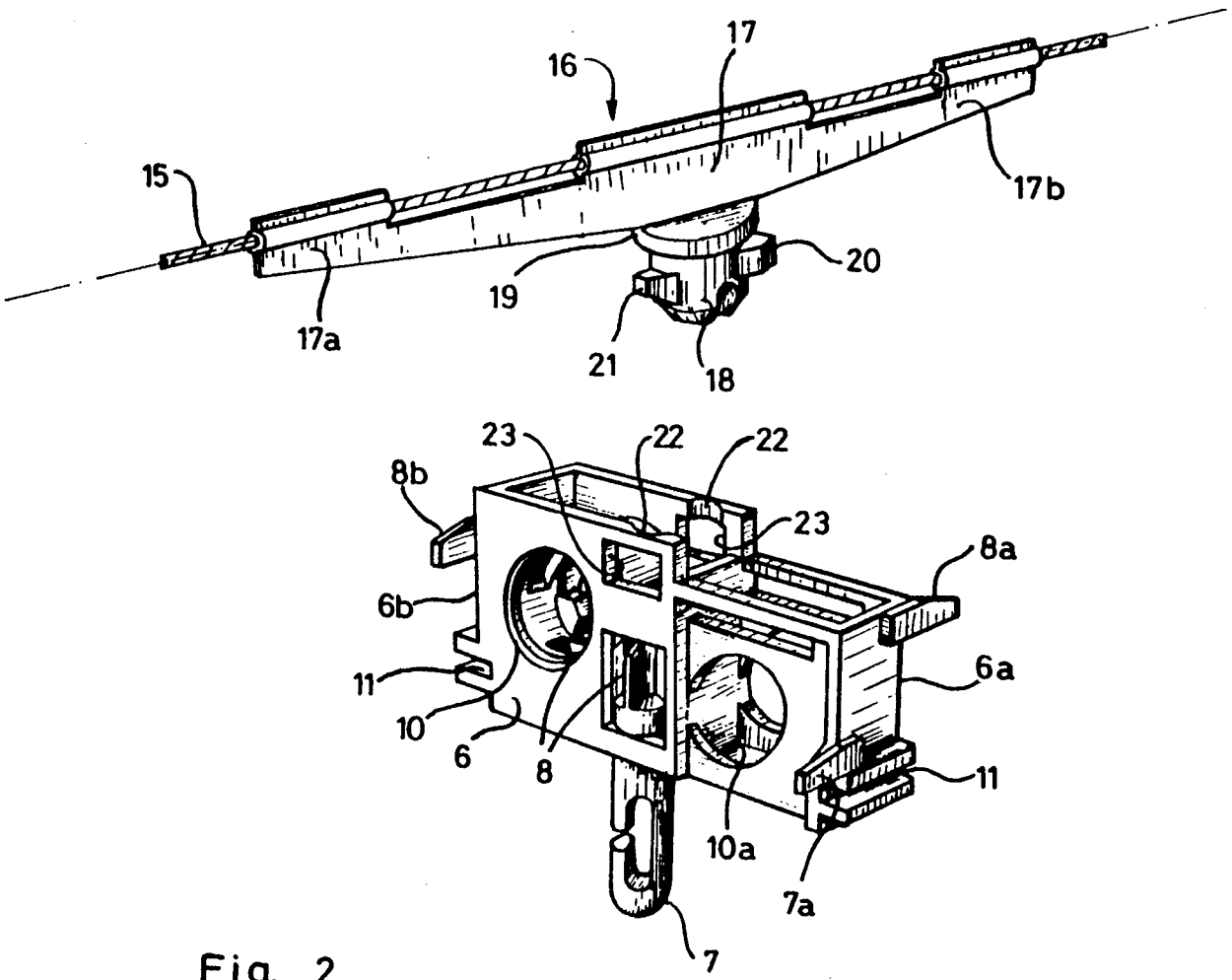
FIG. 2 is an exploded perspective view of a cart for the support in FIG. 1.

Said anchor members 16 are plastics moldings as are the carts 5, and each comprised of or a rod-shaped portion 17 defining two opposed arms 17*a,b* having the string 15 molded in at sections thereof shown as enlarged portions in FIG. 2. It may be seen that the overall length of the rod-shaped portion, measured between the free ends of same, is substantially greater than the cross dimension of the slideway 2 and corresponding cross dimension of the carts 5. Formed at a middle location relatively to the rod-shaped portion and at right angles thereto is a pin 18 having a collar 19 and two pairs of opposed teeth (one tooth in each pair is shown in the figure) shown at 20 and 21 respectively.

Each anchor member is swivel connected to the body 6 of a corresponding cart with the pin 18 coaxial with the hook 7, that is at a middle location on the body. Two undercuts 22 defining a pivot seat for the pin 18 are provided for the purpose on facing surfaces of the opposed major walls of the body 6. Formed beneath the undercuts 22 are respective openings 23 into which a corresponding tooth 21 is snap fitted, such that the anchor member 16 will be held on the body 6 of the corresponding cart 5 with the collar 19 abutting on the top free edge of the major walls of same. If required, the seat for the pin 18 may be offset on the body 6 to take account of the eccentricity of the point of application of the frictional forces resulting from the sum of the friction resistances met by the cart in the slideway, on the one side, plus those imposed on the cart by the splined bar 9, on the other side.

The oscillation of the anchor element 16 relatively to the body 6 is limited to an angle of approximately 20°–40° from a position of the arms 17*a,b* of substantial alignment with the direction of movement of the carts 5 along the slideway 2. This limitation is controlled by the teeth 20 in the first pair interfering with the major walls of the body 6, in one direction, and by the teeth 21 interfering with the contours of the corresponding openings 23 in the opposite direction.

Figure 3:
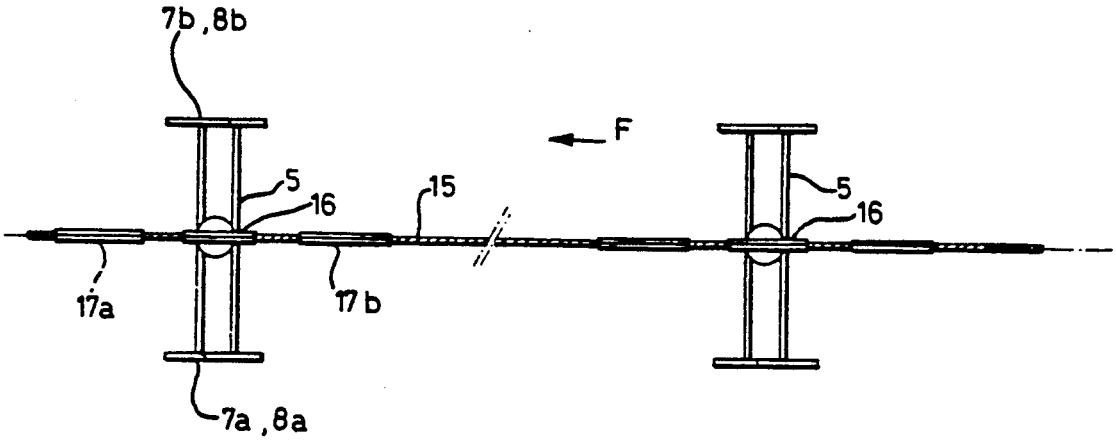
FIGS. 3 to 5 show schematically in top plan view a plurality of carts and their operation when moved from a spread position to a gathered position, respectively.
Figure 4:
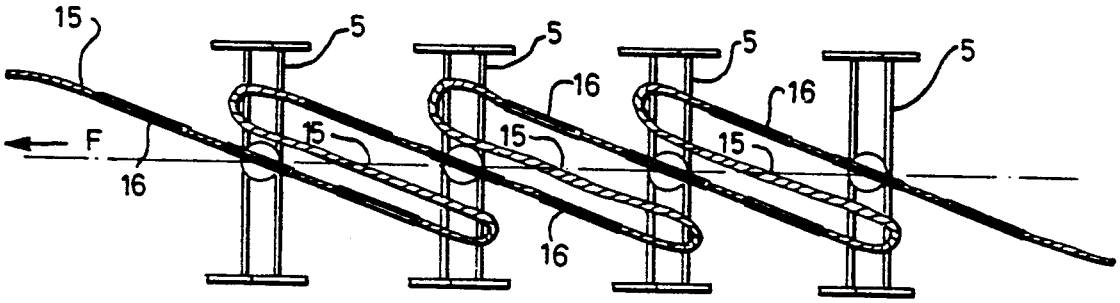
Figure 5:
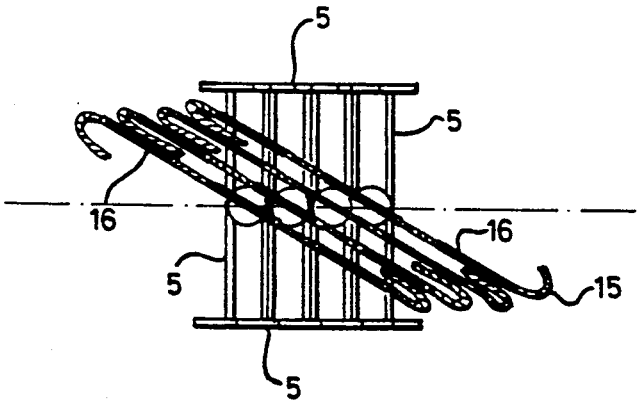

The operation of the inventive support will be now described making specific reference to FIGS. 3 to 5.

In FIG. 3, the carts 5 are shown in their spread positions, such as may occur as the carts are towed out to stretch the louver associated therewith, for example. It may be noted that the arms 17*a, b* of the anchor members are aligned to the towing string 15 and centered to their corresponding carts, such that there may be no components of the towing force tending to cock the carts 5 in the slideway 2. In addition, with the louver stretched, the string will exert no springback action on the carts because it lies on a perfectly straight line.

In FIGS. 4 and 5, the carts are shown in a gathered position (the gap between adjacent carts has been exaggerated in FIG. 4 for clarity). It may be noted that, on the carts being pulled toward one another, the anchor member 16 is swung from its position aligned to the direction of movement of same (arrow F) to a position at an angle of about 20°–30° from the previous one. This oscillation is limited by the teeth 20, 21 to prevent the arm ends from interfering with the side walls of the slideway 2.

As the carts are brought closer to one another, the string 15 segments between adjacent anchor members are flexed into side-by-side bights which are held by the arms 17*a, b* above the carriages 5 and by the bodies themselves of the adjacent carts. This expedient permits of the use of specially thin towing strings of circular cross-sectional shape, without this involving any risk of string bights sagging down between adjacent carts to block the carts in the slideway.

The use of thin strings affords the important advantage of removing any springback from the string apt to bias the carts to their spread positions.

By using circular cross-section strings, moreover, the advantage is secured that a preferential (edge on) orientation of the string during the anchor member molding process is no longer required.

It may be noted, in particular, that the breadth of the string bights can exceed by far the cross dimension of the carts (breadth of the slideway) as a result of the set imposed by the limited oscillation of the anchor members and the support from the arms 17*a, b*.

A further advantage of this invention is that, with any components substantially cancelled of the cart towing force which may tend to cock the carts in the slideway and the shoes provided for added guide, the space requirements of the carts in their direction of movement are significantly reduced, which results in less space being occupied by the curtain in its gathered condition.

What is claimed is:

1. A support for curtains, particularly curtains of the adjustable sun-louver type, comprising a plurality of carts fitting slidably in a slideway and being interconnected by a string for sequentially towing them along said slideway from a gathered position, where said carts are packed together, to a spread position where said carts are set at pitch distances from one another along said slideway, said string being attached to each cart by a corresponding anchor member effective to bias said string to huddle into side-by-side bights above said carts when the latter are packed in said gathered position, each anchor member comprising at least one support arm connected to said string and jutting out from a corresponding cart above said cart for holding said string some distance above the corresponding cart both in the gathered position and spread position of the carts.

2. A support according to claim 1, wherein said at least one arm is, at least with the carts in their gathered position, so arranged relatively to its corresponding cart as to form an angle in the 1° to 89° range with an axis of said slideway coincident with the direction of movement of the carts.

3. A support according to claim 1 wherein said anchor member comprises two opposed substantially aligned arms jutting out from opposed sides of the corresponding cart.

4. A support according to claim 1 wherein said anchor member is swivel mounted to a corresponding one of said carts.

5. A support according to claim 4, wherein said anchor element is pivotable on its corresponding cart between a substantially aligned position with said direction of movement of the carts along said slideway and an angled position to the former.

6. A support according to claim 5, wherein said cart and said anchor member are provided with means of limiting the pivotal movement of said anchor member.

7. A support according to claim 1 wherein the overall reach of said arms is substantially greater than the dimension of said carts in the transverse direction to said direction of movement along said slideway.

8. A support according to claim 1 wherein said anchor member is snap fitted to its corresponding cart.

9. A support according to claim 1, wherein the anchor member is a plastics molded to said string.

10. A support according to claim 1 wherein said anchor member is mounted centrally on its corresponding cart.

11. A support according to claim 1 wherein said support comprises, on each cart, at least one pair of shoes extending laterally of the cart and parallel with the direction of movement of the same and co-operating with side walls of said slideway.

* * * * *